US007458863B2

(12) United States Patent
Shimizu

(10) Patent No.: US 7,458,863 B2
(45) Date of Patent: Dec. 2, 2008

(54) TERMINAL FITTING AND A CONNECTOR

(75) Inventor: Tooru Shimizu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/957,638

(22) Filed: Dec. 17, 2007

(65) Prior Publication Data

US 2008/0146090 A1 Jun. 19, 2008

(30) Foreign Application Priority Data

Dec. 18, 2006 (JP) ..... 2006-340260

(51) Int. Cl.
*H01R 11/22* (2006.01)

(52) U.S. Cl. ..... 439/842; 439/839

(58) Field of Classification Search ..... 439/839–856
See application file for complete search history.

(56) References Cited

U.S. PATENT DOCUMENTS 5,730,629 A 3/1998 Samejima et al.
5,833,500 A 11/1998 Mahon et al.
5,897,405 A 4/1999 Endo
5,911,603 A 6/1999 Mansutti
5,951,338 A * 9/1999 Seko et al. ..... 439/843
6,203,385 B1 * 3/2001 Sato et al. ..... 439/852
6,290,554 B1 * 9/2001 Makita et al. ..... 439/852
6,325,680 B1 * 12/2001 Suzuki ..... 439/852
6,733,346 B2 5/2004 Tsuji et al.
6,752,660 B2 6/2004 Fujita et al.
6,755,697 B2 * 6/2004 Kojima et al. ..... 439/852
6,767,259 B2 * 7/2004 Kojima et al. ..... 439/752
7,104,849 B2 * 9/2006 Nimura ..... 439/856
7,204,725 B2 * 4/2007 Yamashita ..... 439/752
2002/0086590 A1 7/2002 Mitani et al.
2003/0096538 A1 5/2003 Kojima et al.
2004/0157503 A1 8/2004 Fujii
2006/0172615 A1 8/2006 Noro et al.

* cited by examiner

*Primary Examiner*—Briggitte R Hammond
(74) *Attorney, Agent, or Firm*—Gerald E. Hespos; Anthony J. Casella

(57) ABSTRACT

A terminal fitting (11) includes a substantially box-shaped main portion (21). The main portion (21) includes a bottom wall (24), a pair of side walls (25, 26) standing up from the opposite ends of the bottom wall (24), a ceiling wall (27) projecting from the leading end of one (25) of the side walls (25, 26) toward the other side wall (26) while facing the bottom wall (24) and an outer wall (28) projecting from the leading end of the other side wall (26) toward the one side wall (25) and placed on the outer side of the ceiling wall (27). The outer wall (28) has a latch (42) arranged between the two side walls (25, 26) and projecting towards the bottom wall (24). The ceiling wall (27) has an escaping portion (43) for receiving the latch (42) and is engaged with the peripheral edge of the escaping portion (43).

19 Claims, 12 Drawing Sheets

TERMINAL FITTING AND A CONNECTOR

BACKGROUND OF THE INVENTION

1. Field of the Invention

The invention relates to a terminal fitting, a connector and a forming method of a terminal fitting.

2. Description of the Related Art

A conventional terminal has a wire connecting portion to be connected with an end of a wire and a box-shaped main body forward of the wire connecting portion. The box-shaped main body includes a bottom wall, first and second side walls standing up from the opposite lateral sides of the bottom wall, a ceiling wall extending from the leading end of first side wall towards the second side while facing the bottom wall, and an outer wall extending from the leading end of the second side wall towards the first side wall and placed on the outer side of the ceiling wall.

The outer wall cantilevers from the second side wall. Therefore, the outer wall might deform outwardly and open in response to an external force.

U.S. Pat. No. 6,752,660 discloses a terminal fitting intended to prevent an opening deformation of the outer wall. This terminal fitting has a piece that projects farther from the leading end of the outer wall. The piece is bent towards the side wall and engages a cutout formed in the side wall to prevent an opening deformation the outer wall.

The piece of the above-described terminal fitting that engages the cutout projects out from the leading end of the outer wall. Thus, the metal blank for forming the terminal fitting is larger by the projecting distance of the piece, thereby causing an undesirable blank configuration and an inefficient use of the metallic base material. Further, a part of the piece that engages the cutout of the side wall is exposed to the outside and can catch another part in a way that could deform the piece.

The present invention was developed in view of the above situation, and an object thereof is to prevent an opening deformation of an outer wall while miniaturizing a flat stamped-out piece.

SUMMARY OF THE INVENTION

The invention relates to a terminal fitting that has a substantially box-shaped main portion with a first wall. Second and third walls project from the first wall. A fourth wall projects from the second wall towards the third wall and substantially faces the first wall. An outer wall projects from the third wall towards the second wall and is placed at least partly on the outer side of the fourth wall. The outer wall has at least one latch arranged between the second and third walls and projecting substantially towards the first wall. The fourth wall has at least one escaping portion for receiving the latch. Thus, the latch is engageable with at least part of the peripheral edge of the escaping portion.

Engagement of the latch with the peripheral edge of the escaping portion prevents an outward deformation of the outer wall even if an external force acts on the outer wall. The latch is arranged between the second and third walls and is received in the escaping portion in the fourth wall. Thus, the flat metal blank for forming the terminal fitting can be miniaturized as compared to a conventional construction that has a piece on an outer wall to engage a cutout formed in one side wall. Further, the latch is surrounded at least partly by the second and third walls. Accordingly, an edge of the latch is less likely to get caught by other parts as compared to the conventional construction.

The latch preferably is at the leading end of the outer wall and provides a reliable restriction of the opening deformation of the entire outer wall.

The latch preferably is placed on the inner side of the second wall. Thus, the second wall guides the latch during the formation of the terminal fitting from the substantially flat blank and facilitates the production.

The terminal fitting can be accommodated in a housing of a connector. The housing may have a retainer and the outer wall of the terminal fitting may have at least one retainer engaging portion engageable with the retainer. The latch preferably is adjacent to the engaging portion. The arrangement of the latch adjacent the engaging portion substantially prevents the opening deformation of the outer wall even if a pulling force acts on the terminal fitting while the retainer in the housing is engaged with the retainer engaging portion of the outer wall.

The housing preferably has a cavity for receiving the terminal fitting. A lock preferably is formed in the cavity and can be deformed resiliently as the terminal fitting is inserted in the cavity or withdrawn therefrom. The outer wall of the terminal fitting has at least one lock engaging portion that is engageable with the lock in the cavity. The retainer preferably can move back and forth in a direction intersecting the inserting and withdrawing directions of the terminal fitting. The latch of the terminal fitting preferably is adjacent to the retainer engaging portion and is spaced backward from the lock engaging portion. With this construction, an opening deformation of the outer wall is prevented by the disposition of the latch adjacent to the retainer engaging portion even if a pulling force acts on the terminal fitting while the terminal fitting is in the cavity and while the retainer is engaged with the retainer engaging portion of the outer wall. Further, the disposition of the latch rearward from the lock engaging portion avoids interference between the lock and the latch in the process of inserting or withdrawing the terminal fitting into or from the cavity, and hence avoids damage to the latch.

The latch engages the peripheral edge of the escaping portion in the fourth wall. The leading end of the fourth wall also may have a support that contacts the leading end of the third wall for supporting the fourth wall. With this construction, an opening deformation of the outer wall is prevented more effectively since parts of the fourth wall engaged by the latch also are supported by the support.

The escaping portion preferably is formed by cutting the fourth wall. With this construction, lower cost production is possible as compared to forming an escaping portion, for example, by denting, since the cut escaping portion can be formed upon stamping out a base material in a production process.

At least one stabilizer preferably projects outward along the second wall. The stabilizer preferably is formed at a part of the leading end of the second wall substantially facing the escaping portion. With this construction, the metal that is cut to form the escaping portion can be used effectively as the stabilizer and the stabilizer can be arranged without deteriorating blank cutout.

The invention also relates to a connector comprising the above-described terminal fitting and a housing for accommodating the terminal fitting.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 8:
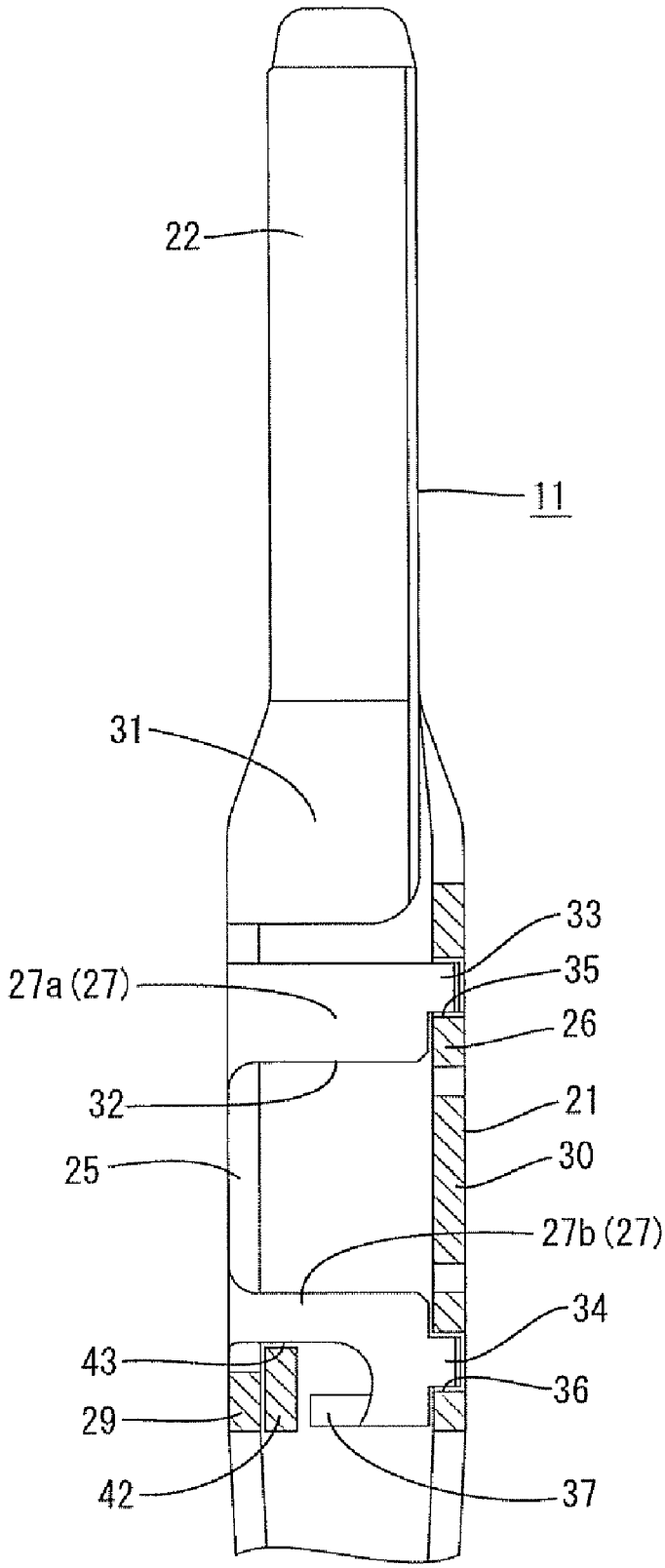
FIG. 8 is a section along VI-VI of FIG. 3.
Figure 9:
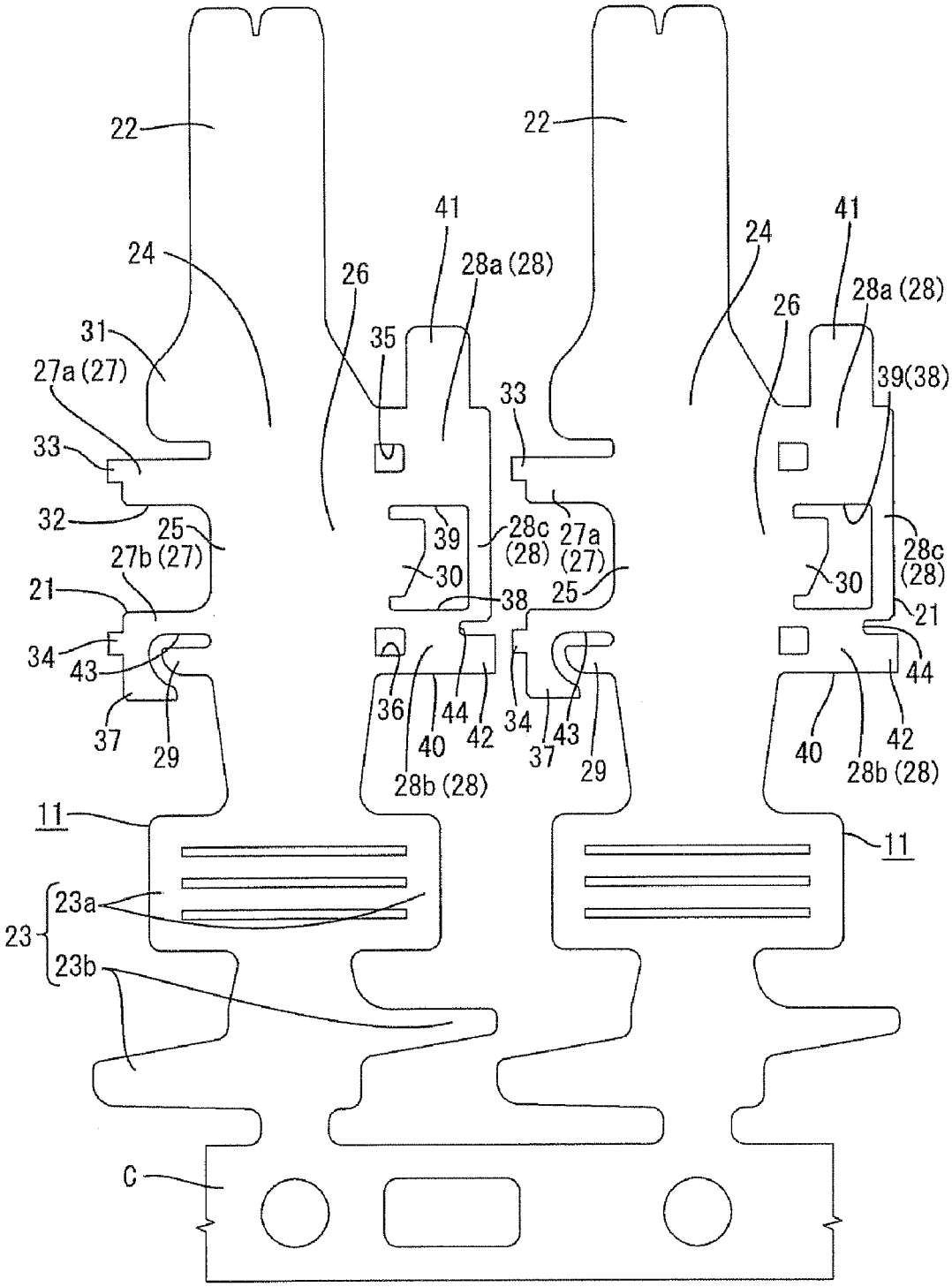
FIG. 9 is a plan view showing a flat state of terminal fittings.
Figure 10:
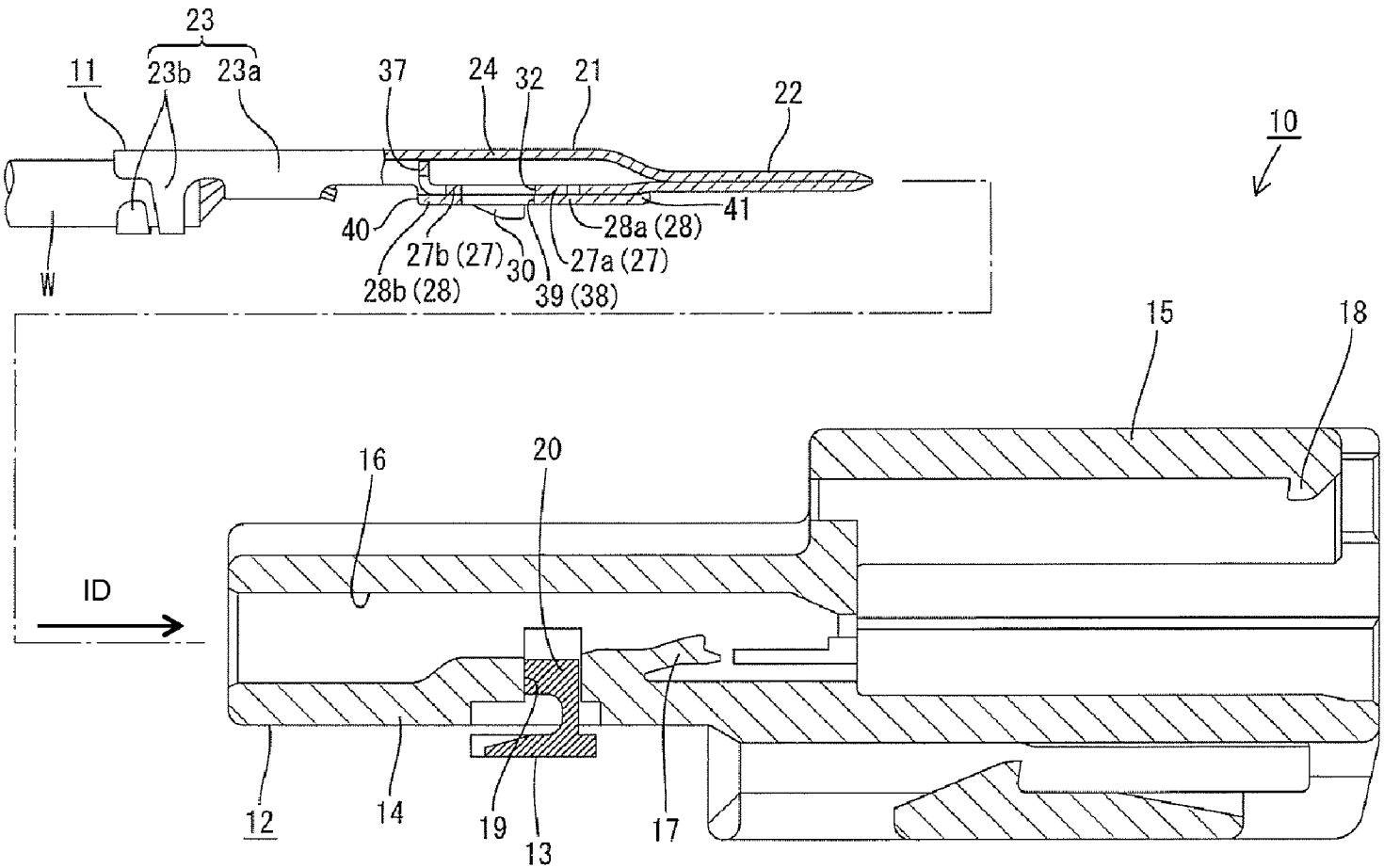
FIG. 10 is a side view in section showing a state before the terminal fitting is inserted into a housing.

A male connector and a male terminal fitting in accordance with the invention are identified respectively by the numerals 10 and 11 in FIGS. 1 to 12. As shown in FIG. 10, the connector 10 has a housing 12 for receiving the terminal fitting 11 while the terminal fitting 11 has been connected with an end of a wire W. In the following description, an inserting direction ID of the terminal fitting 11 into the housing 12 is referred to as forward direction, a substantially opposite direction is referred to as backward direction and reference is made to FIG. 10 concerning the vertical direction.

The housing 12 is made e.g. of synthetic resin and includes a terminal accommodating portion 14 and a forwardly open receptacle 15. A cavity 16 is formed in the terminal accommodating portion 14 and can receive the terminal fitting 11 inserted from behind and along the inserting direction ID. A resiliently deformable lock 17 is cantilevered at the bottom of a front part of the cavity 16. The lock 17 is pressed by the terminal fitting 11 being inserted into the cavity 16 and retracts in a direction intersecting the inserting direction ID into a deformation space at a side of the lock 17 opposite the cavity 16. The lock 17 then returns resiliently for locking the inserted terminal fitting 11

The receptacle 15 is a forwardly open tube and can receive an unillustrated mating female connector from the front. A lock 18 is provided at the front end of the receptacle 15 for holding the mating connector.

A retainer mount hole 19 is formed in the terminal accommodating portion 14 of the housing 12 and can receive a retainer 13 from the outside. The retainer mount hole 19 is formed in the bottom surface of the housing 12 and communicates with the at least one cavity 16. A retaining portion 20 is provided at a part of the retainer 13 that faces the cavity 16 and is capable of retaining the terminal fitting 11. The retainer 13 can be moved substantially normal to inserting and withdrawing directions of the terminal fitting 11 between a partial locking position where the retaining portion 20 is retracted from the cavity 16 to permit the insertion and withdrawal of the terminal fitting 11 and a full locking position where the retaining portion 20 is located in the cavity 16 to lock the terminal fitting 11.

The terminal fitting 11 is formed by bending, folding and/or embossing a substantially flat stamped-out or cut-out piece of a conductive metallic base material. The terminal fitting 11 includes a substantially box-shaped main portion 21. A terminal connecting portion 22 projects forward from the main portion 21 and a wire connecting portion 23 projects backward from the main portion 21, as shown in FIGS. 1 to 4. The terminal connecting portion 22 is a tab that is electrically connectable with a female terminal of the mating connector. More particularly, the terminal connecting portion 22 has a bottom plate that extends in substantially forward and backward directions FBD. A ceiling plate is connected with a lateral edge of the bottom plate and is bent onto the bottom plate. The wire connecting portion 23 is formed with at least one wire barrel 23*a* to be crimped, bent or folded into connection with an exposed core and an insulation barrel 23*b* to be crimped, bent or folded into connection with an insulated part at the end of the wire W.

The main portion 21 includes a bottom wall 24 that is long and narrow in forward and backward directions FBD. Left and right side walls 25, 26 project up from the opposite lateral sides of the bottom wall 24. A ceiling wall 27 projects from the upper end of the left side wall 25 towards the right side wall 26 and faces the bottom wall 24. An outer wall 28 projects from the leading end of the right side wall 26 towards the left side wall 25 and is placed on the outer side of the ceiling wall 27, as shown in FIGS. 1 to 5.

A left stabilizer 29 projects out along the left side wall 25 at a position near the leading end of a rear part of the side wall 25. A right stabilizer 30 projects out along the right side wall 26 at a position near the leading end of an intermediate part of the right side wall 26 in forward and backward directions FBD. The stabilizers 29, 30 are inserted into unillustrated insertion grooves formed in the peripheral surface of the cavity 16 of the housing 12 to guide the insertion and withdrawal of the terminal fitting 11 and to prevent the insertion of the terminal fitting 11 into the cavity 16 in an improper posture. A reinforcement 31 for the terminal connecting portion is provided at the front end of the left side wall 25 and is connected with the base end of the terminal connecting portion 22. The reinforcement 31 faces the bottom wall 24 similar to the ceiling wall 27.

The ceiling wall 27 is divided into front and rear parts 27*a*, 27*b* by a cutout 32 formed in an intermediate part in forward and backward directions FBD. Supports 33, 34 are provided near the leading ends of the front and rear parts 27*a*, 27*b* and project farther towards the right side wall 26. The supports 33, 34 are inserted into corresponding supporting holes 35, 36 formed at a bent corner of the outer wall 28 and are held in contact with edges of the respective supporting holes 35, 36. Thus, the front and rear parts 27*a*, 27*b* are supported substantially parallel to the bottom wall 24.

A lid 37 is provided near the rear end of the rear part 27*b* of the ceiling wall 27 and projects towards the bottom wall 24 to cover at least part of an opening 21*a* near the rear end of the main portion 21. The lid 37 is arranged between the opposite side walls 25, 26 and is bent at a substantially right angle from the rear end of the ceiling wall 27. Additionally, the leading end surface of the lid 37 is in proximity to the bottom wall 24 and an outer peripheral edge of the lid 37 extends along the outer peripheral edge of the left stabilizer 29. The lid 37 is wider towards the leading end thereof. An open range of the opening 21*a* is restricted by the lid 37 to prevent the intrusion of the terminal connecting portion 22 of another terminal fitting 11 into the opening 21*a*.

The outer wall 28 includes a front part 28*a*, a rear part 28*b* and a coupling 28*c* extending between the front and rear parts 28*a* and 28*b*. The coupling 28*c* is configured to define a cutout 38 between the front and rear parts 28*a* and 28*b*. The cutout 38 is formed in a longitudinal middle part of the outer wall 28 and in a position corresponding to the second stabilizer 30 on the second side wall 26. Additionally, the cutout 38 communicates with the cutout 32 of the ceiling wall 27. A lock engaging edge 39 is defined at the rear end of the front part 28*a* of the outer wall 28 and adjacent the cutout 38. The lock 17 enters the cutout 38 and engages the lock engaging edge 39 when the terminal fitting 11 is inserted into the cavity 16 to lock the terminal fitting 11.

A retainer engaging edge 40 is defined at the rear end of the rear part 28*b* of the outer wall 28 and engages the retaining portion 20 of the retainer 13. Further, a projection 41 projects forward from the front end of the front part 28*a* of the outer wall 28 and is placed on the base end of the terminal connecting portion 22.

Figure 1:
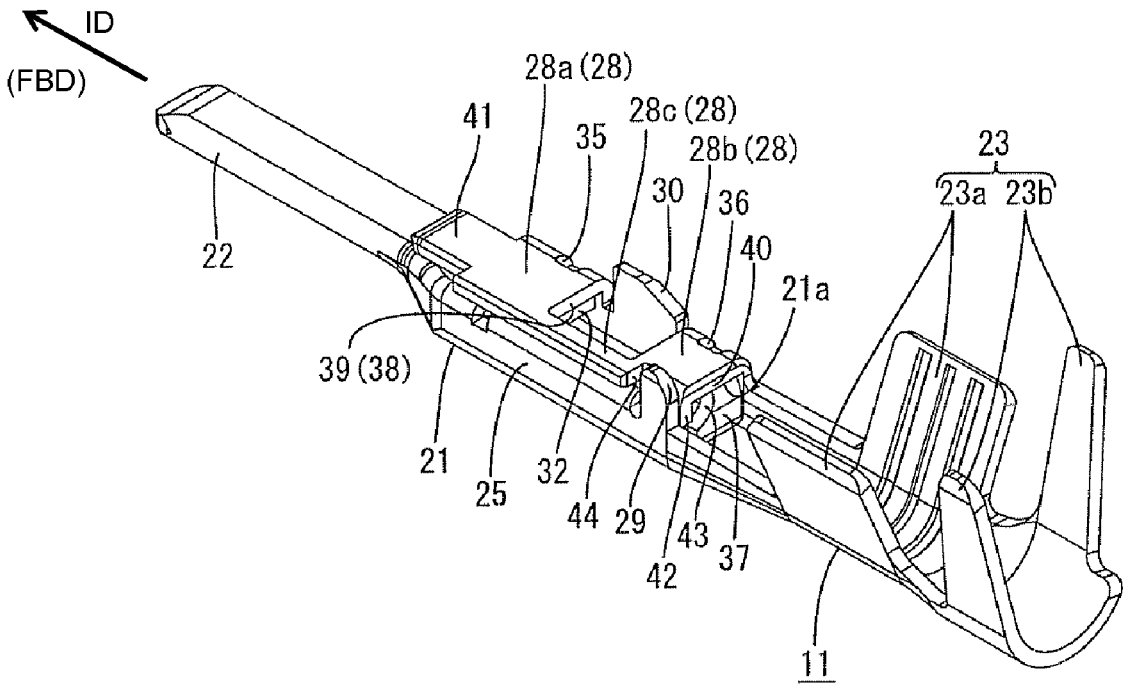
FIG. 1 is a perspective view of a terminal fitting according to one embodiment of the invention.
Figure 2:
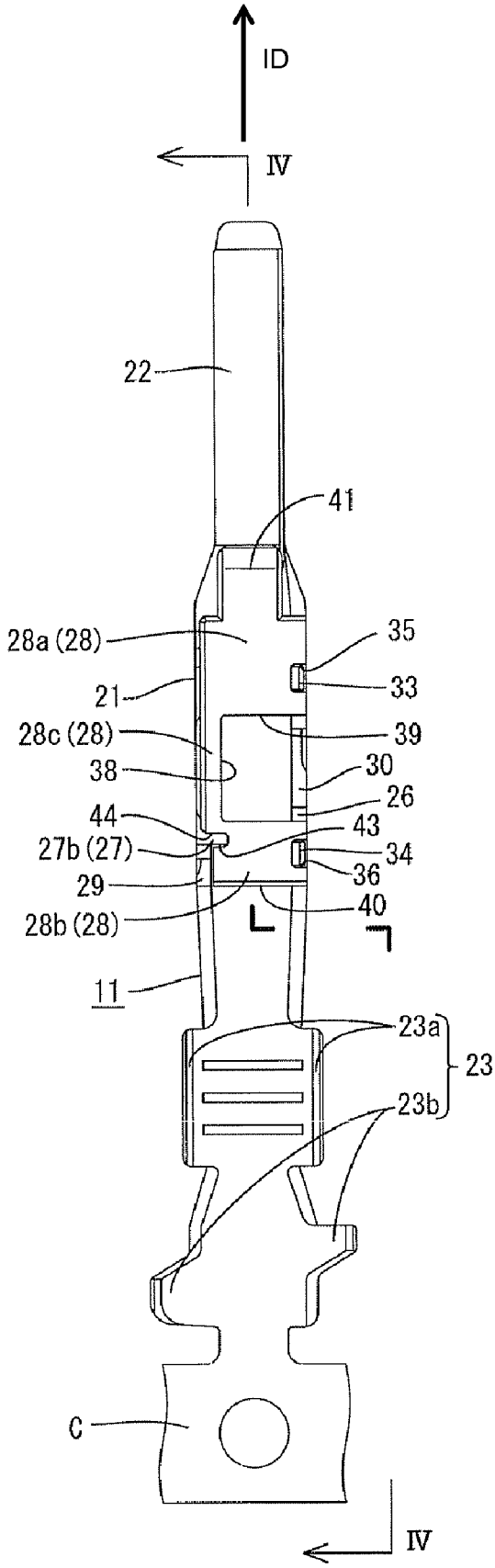
FIG. 2 is a plan view of the terminal fitting.
Figure 3:
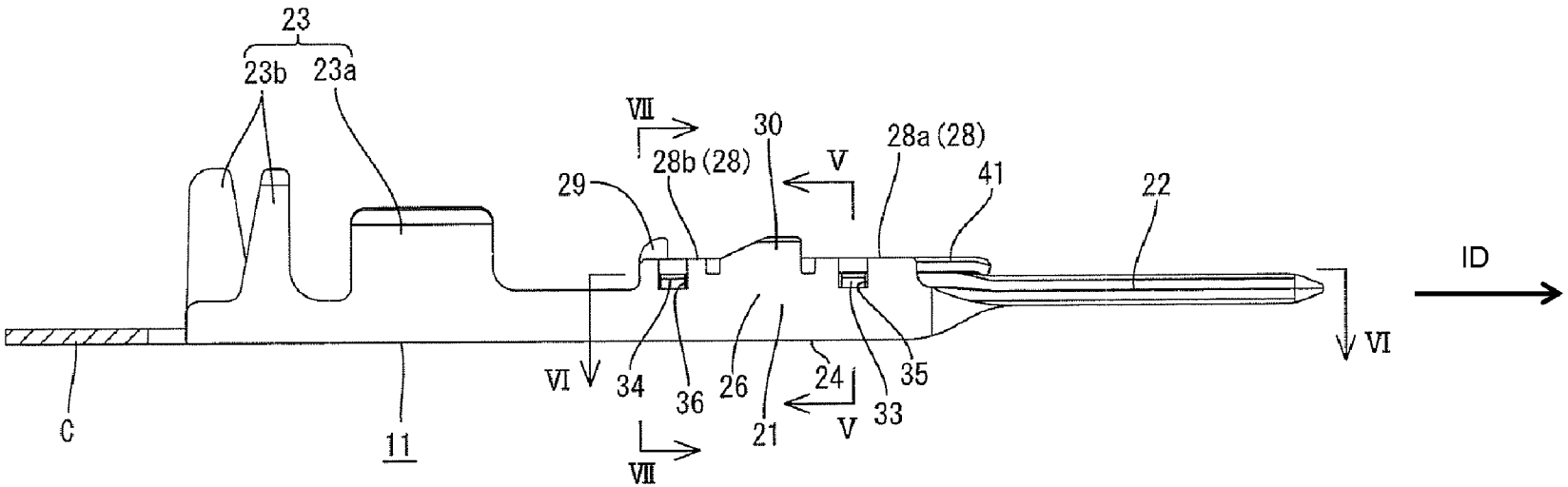
FIG. 3 is a side view of the terminal fitting.
Figure 4:
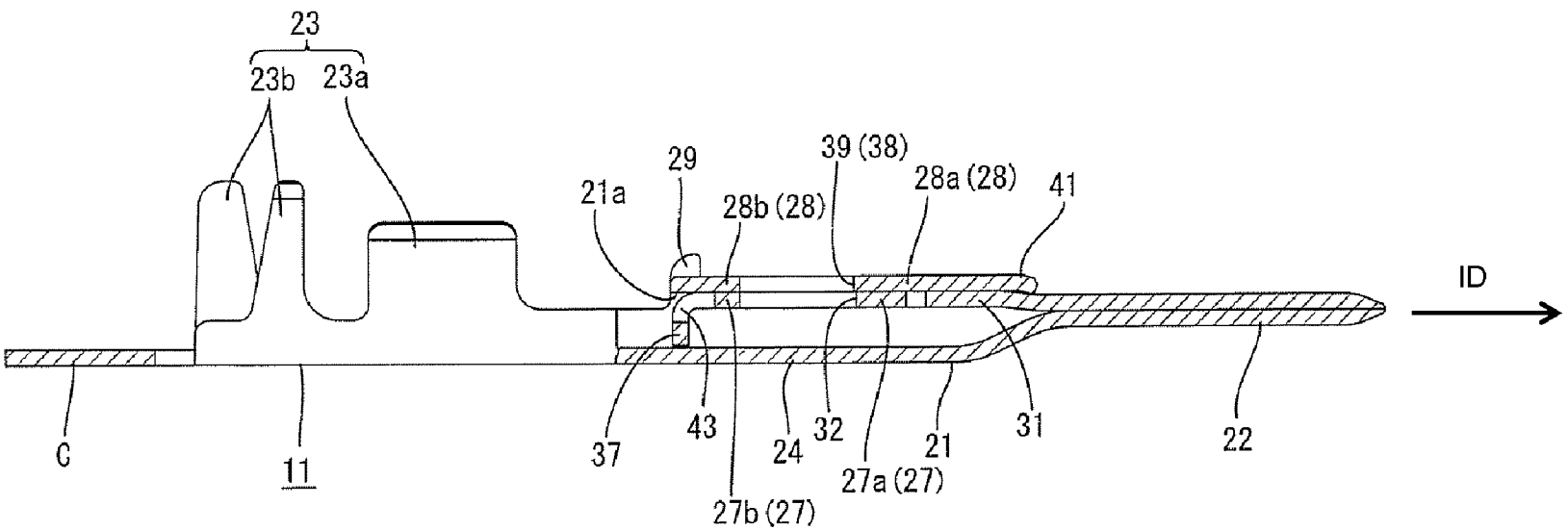
FIG. 4 is a section along IV-IV of FIG. 2.
Figure 5:
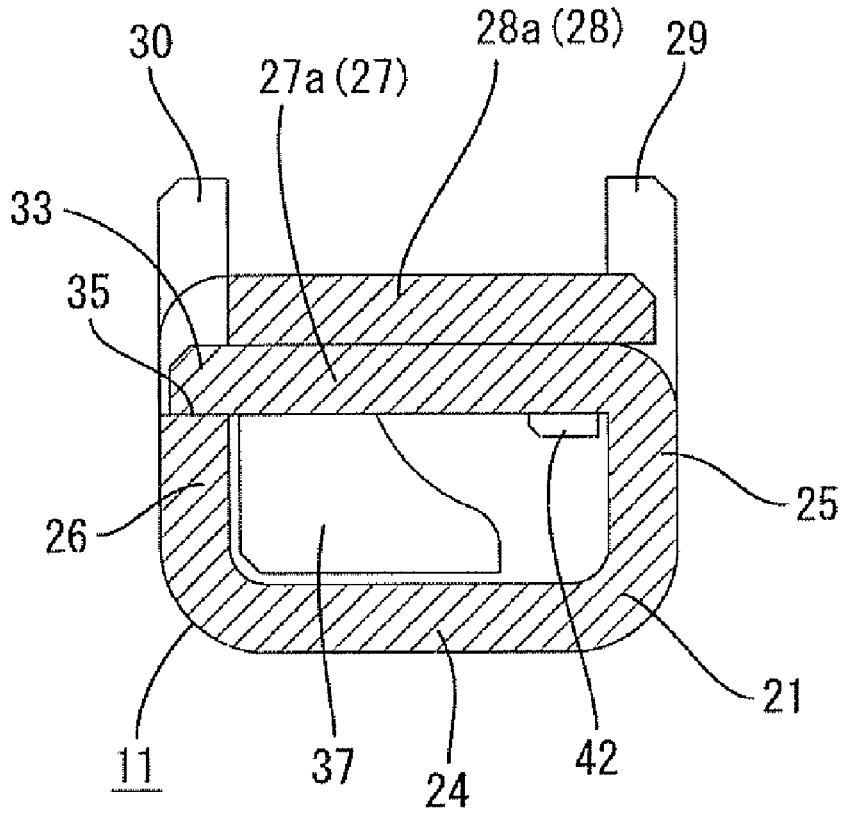
FIG. 5 is a section along V-V of FIG. 3.
Figure 6:
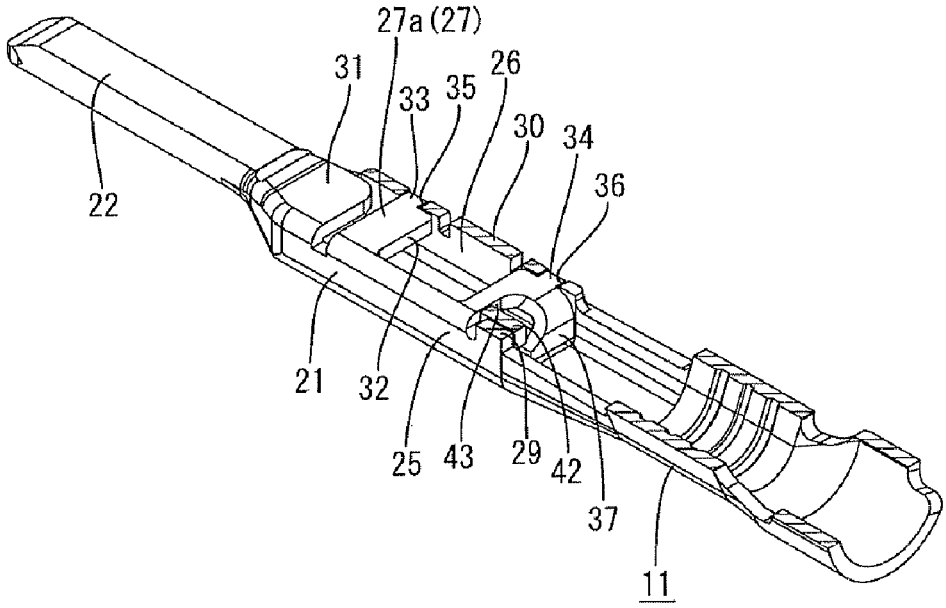
FIG. 6 is a perspective view showing a state cut along VI-VI of FIG. 3.

As shown in FIGS. 1 and 6, a latch 42 projects from the outer wall 28 towards the bottom wall 24, and an escaping portion 43 is formed in the ceiling wall 27 for receiving the latch 42. Specifically, the latch 42 is formed by cutting a slit 44 at the leading end of the rear part 28*b* of the outer wall 28 and bending a section behind the slit 33 in so that an end surface remote from the bend faces the bottom wall 24. On the other hand, the escaping portion 43 is formed by cutting off sections of the rear part 27*b* of the ceiling wall 27 and the lid 37 corresponding to the latch 42 over a specified range in forward and backward directions FBD. The bent latch 42 escapes into the escaping portion 43 and engages the peripheral edge of the escaping portion 43 at the rear part 27*b* of the ceiling wall 27 to restrict an opening deformation of the outer wall 28.

The slit 44 extends straight in the width direction at a position on the rear part 28*b* of the outer wall 28 near the coupling 28*c* and has an open lateral side, as shown in FIG. 9. The lateral edge of the latch 42 projects slightly out beyond the projecting lateral edges of the coupling 28*c* and the front part 28*a* of the outer wall 28. The front end edge of the latch 42 is aligned substantially with the front edge of the escaping portion 43. The rear edge of the latch 42 is substantially flush with the rear edge of the rear part 28*b* of the outer wall 28, and the rear edges of the retainer engaging portion 40 and the stabilizer 29 on the left side wall 25. The length of the latch 42 in forward and backward directions FBD exceeds the length of the stabilizer 29 by a specified dimension. The latch 42 is at a position adjacent to the retainer engaging portion 40 and is distanced back from the lock engaging portion 39.

The escaping portion 43 is formed by cutting the rear part 27*b* of the ceiling wall 27 and the lid 37 along the outer peripheral edge of the stabilizer 29 to have a substantially arcuate shape. In other words, the stabilizer 29 projects from a part of the leading end of the left wall 25 facing the escaping portion 43, and utilizes a space created upon forming the escaping portion 43.

Figure 7:
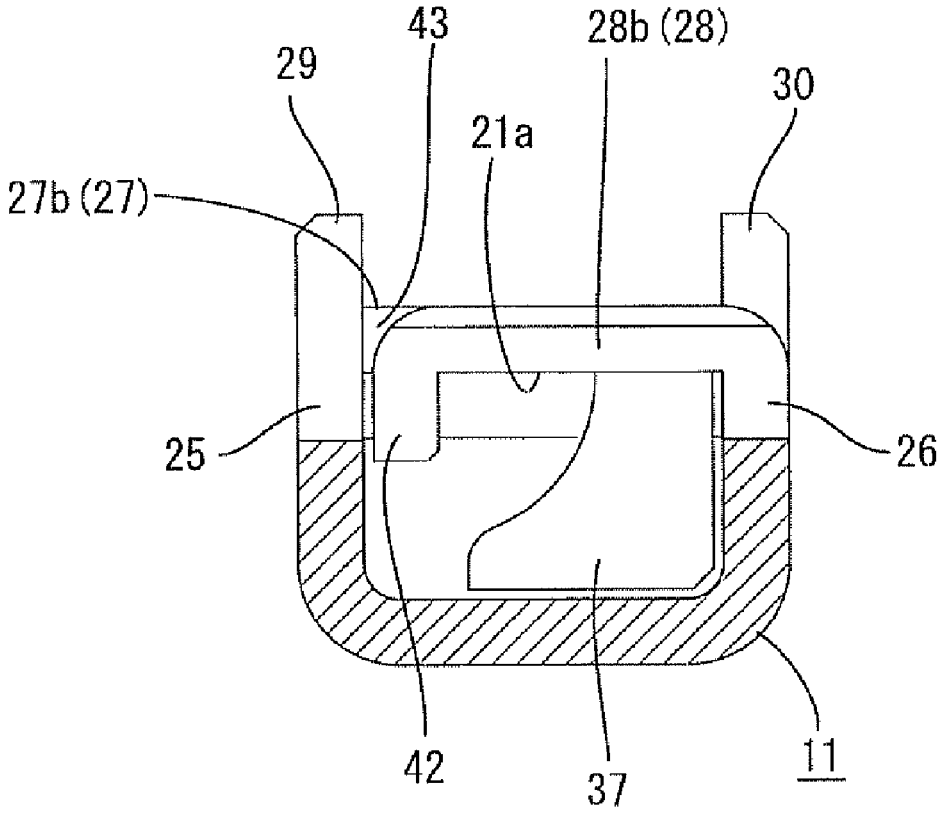
FIG. 7 is a section along VII-VII of FIG. 3.

As shown in FIGS. 6 to 8, the latch 42 is bent in at the rear part 28*b* of the outer wall 28 so that the plate surfaces of the latch 42 are substantially parallel to those of the side walls 25, 26. A bending line of the latch 42 substantially coincides with forward and backward directions FBD. The bent position of the latch 42 is within the width of the main portion 21 and is adjacent the inner side of the left side wall 25. Accordingly, the latch 42 is between the two side walls 25, 26 and is surrounded by the side walls 25, 26 at the opposite lateral sides to prevent exposure of an edge thereof to the outside. The latch 42 is placed on the inner side of the one side wall 25, and the outer plate surface of the latch 42 contacts the inner plate surface of the left side wall 25. The front end surface of the latch 42 is engageable with the front edge of the escaping portion 43. The front edge of the latch 42 as a locking surface is cut upon stamping out a flat piece of a conductive metallic base. The leading end surface of the latch 42 reaches a position to project more towards the bottom wall 24 than the inner surface of the rear part 27*b* of the ceiling wall 27, and the front end surface of the latch 42 is engaged over substantially the entire thickness range of the rear part 27*b* of the ceiling wall 27. The latch 42 is in the opening 21*a* at the rear end of the main portion 21 and, together with the lid 37, restricts the opening range of the opening 21*a*.

The conductive base material is stamped out by a die to obtain substantially flat cut pieces, as shown in FIG. 9. A multitude of terminal fittings 11 in a substantially flat state have their rear ends coupled to a carrier C and are arranged along the extending direction of the carrier C, which is substantially normal to forward and backward directions FBD. The conductive base material then is bent, folded, embossed or the like to form the terminal fitting 11 shown in FIG. 1. The stamping and the bending of the metallic base material can be performed simultaneously using the same die.

The terminal fittings 11 are transported to a harness production site. The wire connecting portions 23 of the terminal fittings 11 then are connected with wires W that have had insulation coatings stripped off their end portions. The terminal fittings 11 connected with the wires W then are bundled together and transported to an assembling site to be assembled into the housings 12. In this transportation process, there is a possibility that the terminal fittings 11 interfere with each other. However, the openings 21*a* at the rear ends of the main portions 21 are restricted by the lids 37 and the latches 42. Thus, the terminal connecting portion 22 of one terminal fitting 11 cannot fit into the opening 21*a* of another terminal fitting 11, and the deformation of the terminal fittings 11 during transportation can be prevented.

The connector is assembled at an assembly site by mounting the retainer 13 in the housing 12 at the partial locking position. The terminal fitting 11 then is inserted into the cavity 16 of the housing 12 from behind and along the inserting direction ID, as shown in FIG. 10. As a result, the lock 17 projecting into the cavity 16 is pressed by the terminal fitting 11 and is deformed into the deformation space. The latch 42 is spaced back from the lock engaging portion 39 and cannot interfere with the lock 17 during this insertion process.

Figure 11:
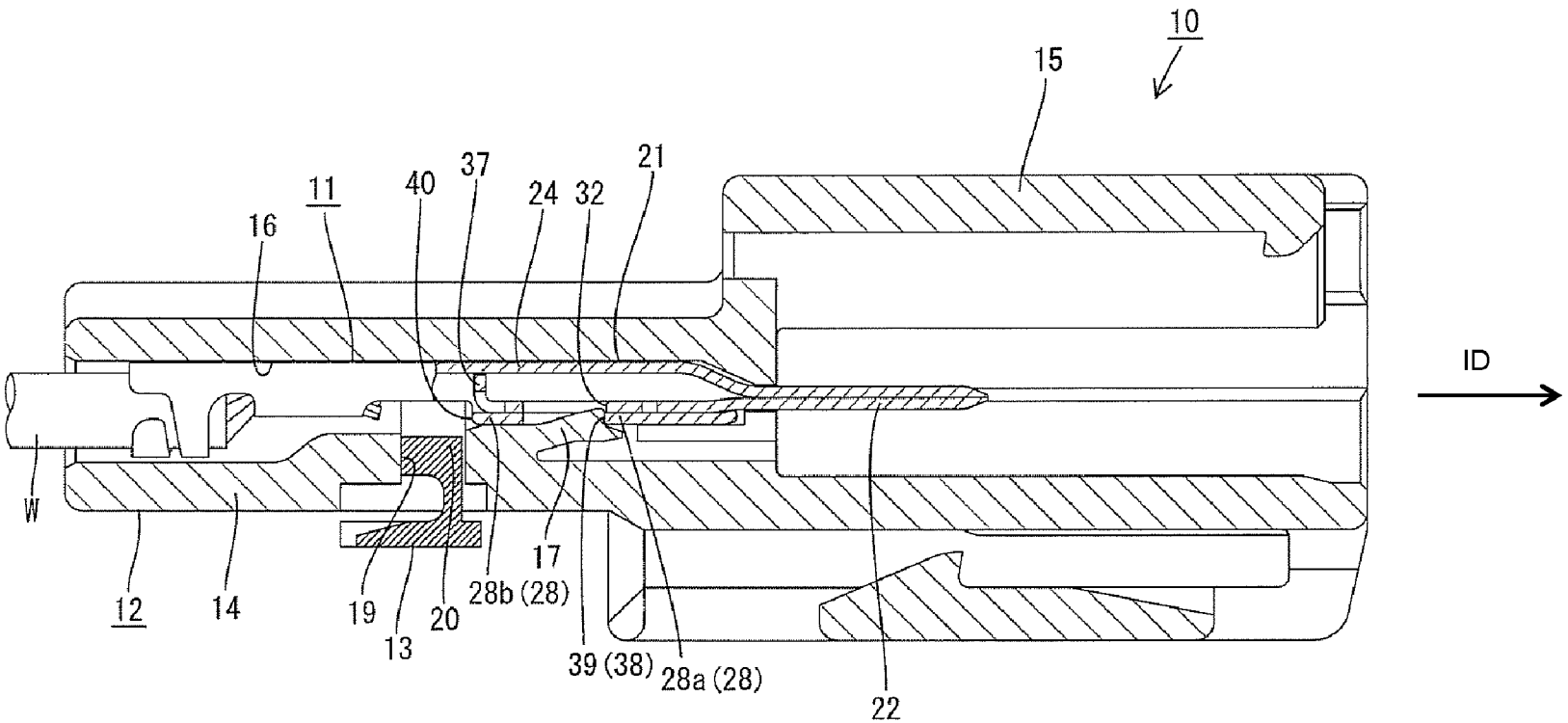
FIG. 11 is a side view in section showing a state where the terminal fitting is inserted into the housing.
Figure 12:
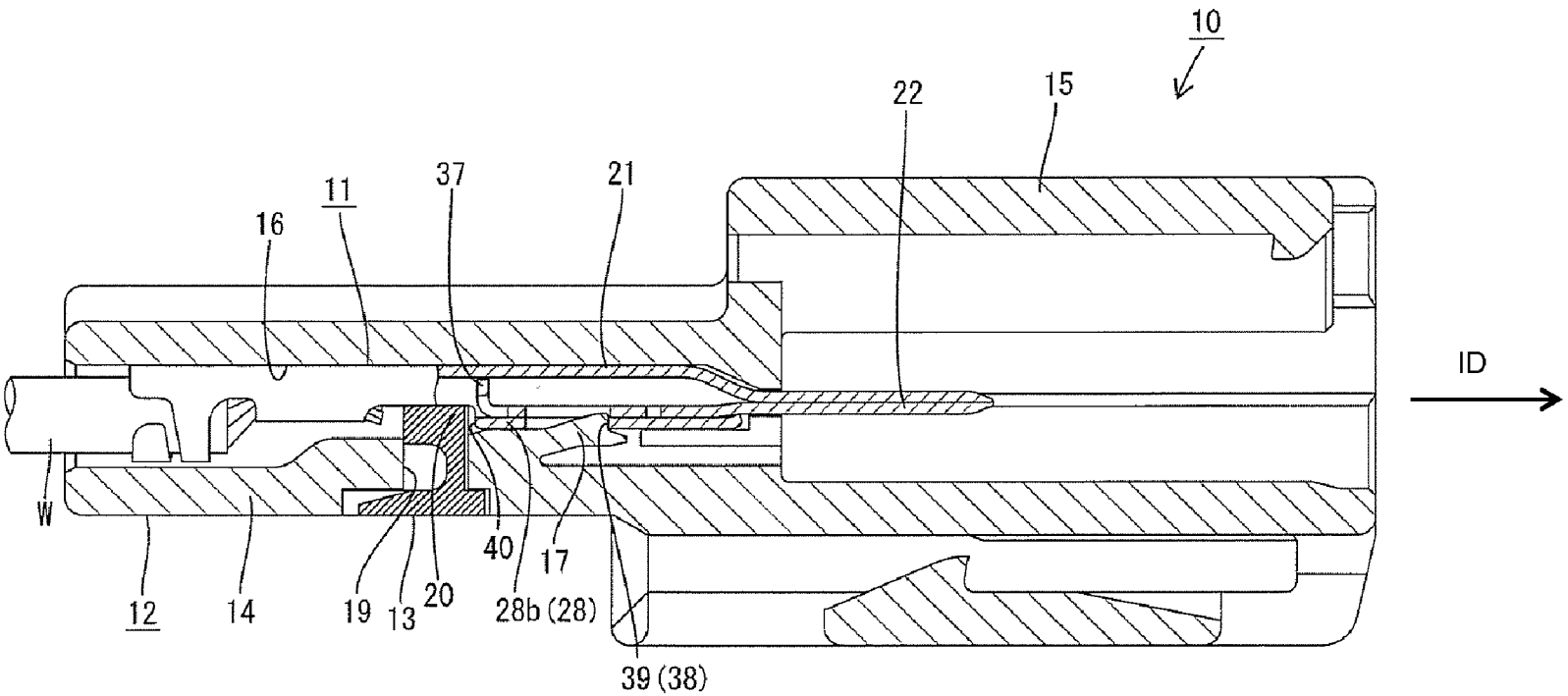
FIG. 12 is a side view in section showing a state where a retainer is at a full locking position.

The lock 17 resiliently restores when the terminal fitting 11 is inserted to a proper depth and enters the cutout 38. As a result, the leading end of the lock 17 engages the lock engaging portion 39 as shown in FIG. 11. The retainer 13 then is pushed from the partial locking position to the full locking position so that the retaining portion 20 enters the cavity 16 and engages the retainer engaging portion 40 for doubly locking the terminal fitting 11 in the cavity 16.

A pulling force could be exerted on the wire W in this locked state. The retainer engaging portion 40 is the part of the terminal fitting 11 engaged with the retainer 13 and receives a major part of any pulling force on the wire W. The retainer engaging portion 40 is on the rear part 28*b* of the outer wall 28, and hence the rear part 28*b* of the outer wall 28 might be deformed outward by the pulling force. However, the latch 42 at the leading end of the outer wall 28 is engaged with the peripheral edge of the escaping portion 43 in the ceiling wall 27 to prevent an opening deformation of the outer wall 28. Further, the rear part 27*b* of the ceiling wall 27 where the escaping portion 43 is formed is difficult to deform because of the support 34 engages the supporting hole 36 for further resisting an opening deformation of the outer wall 28.

The terminal fitting 11 may have to be detached from the housing 12 for maintenance or other reason. Accordingly, the retainer 13 is moved from the full locking position to the partial locking position and a jig is used to deform the lock 17 so that the terminal fitting 11 can be withdrawn. The latch 42 will avoid interference with the lock 17 during this detachment process as well.

The interval between the terminal fittings 11 is increased if outwardly projecting parts are provided at positions on adjacent terminal fittings 11 facing each other on the blank shown in FIG. 9 and results in poor blank cutout. Conventionally, pieces are formed to project farther out from the leading edges of the outer walls, and the blank cutout is poor by that much. However, the latch 42 of the subject invention is formed by cutting the slit 44 in the outer wall 28 and the leading edge of the latch 42 projects only slightly out from the front part 28*a* and coupling 28*c* of the outer wall 28. Thus, the sizes of the terminal fittings 11 and the intervals between the terminal fittings 11 on the blank can be kept small so that the blank cutout is better. The latch 42 escapes into the escaping portion 43 in the ceiling wall 27 upon forming the terminal fitting 11 and the front edge of the latch 42 engages the front edge of the escaping portion 43 to prevent deformation of the outer wall 28. In addition, the latch 42 is at least partly surrounded by the side walls 25, 26 in the formed state to prevent exposure of the edge of the latch 42 to the outside. As a result, other components outside are unlikely to get caught by the edge of the latch 42.

The latch 42 is at the edge of the outer wall 28 opposite the side coupled to the right side wall 26. Thus, opening deformation of the outer wall 28 is prevented more reliably prevented.

The latch 42 is placed on the inner surface of the left side wall 25. Thus, the left side wall 25 guides the latch 42 upon forming the terminal fitting 11 from the flat blank so that the terminal fitting 11 can be produced easily.

The latch 42 is adjacent to the retainer engaging portion 40 where the retainer 13 engages the terminal fitting 11, and hence the latch 42 is at a position where a large pulling force may act on the terminal fitting 11. Thus, the latch 42 prevents an opening deformation of the outer wall 28 more effectively. The latch 42 also is spaced back from the lock engaging portion 39. Accordingly, the lock 17 and the latch 42 will not interfere with one another in the process of inserting or withdrawing the terminal fitting 11 into or from the cavity 16, and neither the latch 42 nor the lock 17 will be damaged.

The support 34 is at the leading lateral edge of the ceiling wall 27 and contacts the peripheral edge of the supporting hole 36 adjacent the right side wall 26 for supporting the ceiling wall 27. Additionally, the latch 42 engages the peripheral edge of the escaping portion 43 to support the ceiling wall 27 steadily. Accordingly, opening deformation of the outer wall 28 is prevented more effectively.

The escaping portion 43 is formed by cutting the ceiling wall 27 while stamping out the conductive metallic base material during the production of the terminal fitting 11. Thus, production costs are less than the case where an escaping portion is formed by denting the ceiling wall 27 after stamping the blank. Besides, an escaping recess formed by denting the ceiling wall 27 would unavoidably form a curved surface (R-surface) at the periphery of the escaping portion for engaging the latch 42. In contrast, the escaping portion 43 of this invention is formed by cutting the ceiling wall 27 and the periphery of the escaping portion 43 is a sharp edge. Therefore, the opening deformation of the outer wall 28 is prevented even more reliably.

The stabilizer 29 projects out along the leading lateral edge of the left side wall 25 facing the escaping portion 43. Thus, the stabilizer 29 and the escaping portion 43 are formed in the ceiling wall 27 by cutting in the substantially flat state, and the space formed by cut-forming the escaping portion 43 is utilized efficiently. Accordingly, the stabilizer 29 is provided without deteriorating the blank cutout as compared to the case where a stabilizer is at a position different from the escaping portion 43.

The invention is not limited to the above described and illustrated embodiment. For example, the following embodiments are also embraced by the technical scope of the present invention as defined by the claims.

Although the latch is placed on the inner side of the side wall in the foregoing embodiment, it may be arranged, for example, at a position distanced from the one side wall according to the present invention since it is sufficient to arrange the latching portion between the two side walls.

The latch is formed at the leading end of the outer wall in the foregoing embodiment, but it may be formed in an intermediate part or at a base end of the outer wall.

The latch is formed by the slit having an open lateral side at the leading end of the outer wall and bending the part of the outer wall behind the slit so that the plate surfaces of the latch are parallel to the side walls in the foregoing embodiment. However, it may be formed, for example, by forming a slit having an open rear side in the outer wall and bending a part of the outer wall at the outer side of the slit so that the plate surfaces of the latch are normal to those of the side walls and face the peripheral edge of the escaping portion.

The position and number of the latches can be changed. For example, latches also may be provided at the front part and coupling portion of the outer wall and escaping portions for receiving the latches may be formed in corresponding parts of the ceiling wall.

The shape of the latch can be changed. For example, the latch may be supported at both ends or may bulge out by having the outer wall thereof struck. Such latches also are embraced by the present invention.

The escaping portion is formed by cutting the ceiling wall in the foregoing embodiment. However, bending, embossing, recessing or striking may be applied to the ceiling wall to form an escaping portion in the form of a recess and such an escaping portion is also embraced by the present invention.

Peripheral edges of the escaping portion and the stabilizer on the one side wall have substantially arcuate shapes substantially conforming to each other in the foregoing embodiment. However, it is also possible to change the shapes of the both peripheral edges to other shapes such as rectangular shapes or to make them different from each other.

The lock engaging portion and the retainer engaging portion are provided at the outer wall in the foregoing embodiment. However, both engaging portions may be provided at a different wall of the main portion. Particularly, if the retainer engaging portion is at the outer wall and the lock engaging portion is at the bottom wall and another latch is provided at the front part of the outer wall, the function of preventing the opening deformation of the outer wall can be strengthened and, in addition, the lock does not interfere with the latch in the process of inserting or withdrawing the terminal fitting.

The cutouts are formed in the outer wall and the ceiling wall in the foregoing embodiment. However, the formation range of the cutouts may be changed. For example, the outer wall may be divided into front and rear parts or front and rear parts of the ceiling wall may be coupled by a coupling portion. Further, the cutouts of the outer wall and the ceiling wall may be omitted.

Stabilizers are provided on both side walls in the foregoing embodiment. However, one or both of the stabilizers may be omitted.

The rear end of the rear part of the outer wall serves as the retainer engaging portion and the front edge of the cutout of the ceiling wall serves as the locking-portion engaging portion in the foregoing embodiment. However, these parts may be arranged in a reverse manner.

The connector includes the lock and the retainer for retaining the terminal fitting. However, the lock or the retainer may be omitted. Further, both the lock and the retainer may be omitted if, for example, the terminal fitting has a metal lock and the housing has a retaining portion for locking the metal lock.

A male terminal fitting and a male connector are illustrated in the foregoing embodiment. However, the invention is also applicable to female terminal fittings and female connectors.

A crimping terminal fitting to be crimped, bent or folded into connection with the end of the wire is illustrated in the foregoing embodiment. However, the invention is also applicable to insulation displacement terminal fittings to be connected with ends of wires by insulation displacements or to terminal fittings clamped or soldered into connection with the wires.

What is claimed is:

1. A terminal fitting comprising a substantially box-shaped main portion including:

a first wall;

second and third walls projecting from the first wall;

a fourth wall projecting from the second wall towards the third wall and substantially facing the first wall;

an outer wall projecting from third wall towards the second wall and placed at least partly on an outer surface of the fourth wall;

at least one latch projecting from the outer wall towards the first wall and arranged between the second and third walls; and at least one escaping portion formed in the fourth wall and receiving at least part of the latch, the latch engaging at least part of a peripheral edge of the escaping portion.

2. The terminal fitting of claim 1, wherein the latch project from a leading lateral edge of the outer wall.

3. The terminal fitting of claim 2, wherein the latch is placed substantially on an inwardly facing surface of the second wall.

4. The terminal fitting of claim 1, wherein the outer wall has at least one retainer engaging portion and the latch is adjacent to the retainer engaging portion.

5. The terminal fitting of claim 4, wherein the outer wall of the terminal fitting has at least one lock engaging portion, the latch being substantially adjacent to the retainer engaging portion and distanced back from the lock engaging portion.

6. The terminal fitting of claim 1, wherein the fourth wall has a leading lateral edge and at least one support at the leading lateral edge of the fourth wall, the support being disposed and configured for contacting a leading lateral edge of the third wall for supporting the fourth wall.

7. The terminal fitting of claim 1, wherein the escaping portion is formed by a cut in the fourth wall.

8. The terminal fitting of claim 7, further comprising at least one stabilizer projecting outward along the second wall and substantially facing the escaping portion.

9. A terminal fitting comprising a substantially box-shaped main portion including:

a base wall;

left and right side walls projecting from the base wall;

a ceiling wall projecting from the left side wall towards the right side wall and substantially facing the base wall;

an outer wall projecting from right side wall towards the left side wall and placed at least partly on an outer surface of the ceiling wall;

a latch projecting from a lateral edge of the outer wall towards the base wall and arranged substantially on a surface of the left side wall facing the right side wall; and an escaping portion cut in the ceiling wall and receiving at least part of the latch so that the latch engages at least part of a peripheral edge of the escaping portion.

10. The terminal fitting of claim 9, further comprising a support projecting from a lateral edge of the ceiling wall opposite the left side wall, the support contacting a leading lateral edge of the right side wall for supporting the ceiling wall.

11. The terminal fitting of claim 9, further comprising at least one stabilizer projecting outward along the left side wall and substantially aligned with the escaping portion.

12. A connector, comprising:

a housing having at least one cavity; and a terminal fitting accommodated in the cavity, the terminal fitting having a substantially box-shaped main portion including a first wall, second and third walls projecting from the first wall, a fourth wall projecting from the second wall towards the third wall and substantially facing the first wall, an outer wall projecting from third wall toward the second wall and placed at least partly on an outer side of the fourth wall, at least one latch projecting from the outer wall towards the first wall and arranged between the second and third walls, 26, and at least one escaping portion formed in the fourth wall and receiving at least part of the latch, the latch engaging at least part of a peripheral edge of the escaping portion.

13. The connector of claim 12, further comprising a retainer mounted in the housing and being move back and forth in a direction intersecting an inserting direction of the terminal fitting into the cavity, the outer wall of the terminal fitting having at least one retainer engaging portion for engaging the retainer, the latch being substantially adjacent to the retainer engaging portion.

14. The connector of claim 13, wherein the housing has at least one resiliently deformable lock projecting into the cavity, and the outer wall of the terminal fitting has at least one lock engaging portion engageable with the lock, the latch being substantially adjacent to the retainer engaging portion and distanced back from the lock engaging portion.

15. The connector of claim 14, wherein the latch is provided at a leading lateral edge of the outer wall.

16. The connector of claim 15, wherein the latch is placed substantially on an inner surface of the second wall.

17. The connector of claim 12, wherein the fourth wall has a leading lateral edge, at least one support at the leading lateral edge of the fourth wall, the support contacting a leading lateral edge of the third wall for supporting the fourth wall.

18. The connector of claim 12, wherein the escaping portion is formed by a cut in the fourth wall.

19. The terminal fitting of claim 18, further comprising at least one stabilizer projecting outward along the second wall and substantially facing the escaping portion.

* * * * *